US010950397B2

(12) United States Patent
Shan et al.

(10) Patent No.: US 10,950,397 B2
(45) Date of Patent: Mar. 16, 2021

(54) SWITCHING AND OPERATING ASSEMBLY OF A SWITCH

(71) Applicant: Schneider Electric (Australia) Pty. Ltd., Macquarie Park (AU)

(72) Inventors: Fuhua Shan, Shenzhen (CN); Dahai Zhang, Shenzhen (CN); Zhen Ma, Shenzhen (CN)

(73) Assignee: SCHNEIDER ELECTRIC (AUSTRALIA) PTY LTD, Macquarie Park (AU)

( * ) Notice: Subject to any disclaimer, the term of this patent is extended or adjusted under 35 U.S.C. 154(b) by 0 days.

(21) Appl. No.: 16/165,463

(22) Filed: Oct. 19, 2018

(65) Prior Publication Data

US 2020/0126739 A1 Apr. 23, 2020

(51) Int. Cl.

*H01H 23/16* (2006.01)
*H01H 23/04* (2006.01)
*H01H 23/24* (2006.01)

(52) U.S. Cl.

CPC ..... *H01H 23/16* (2013.01); *H01H 23/04* (2013.01); *H01H 23/24* (2013.01)

(58) Field of Classification Search

CPC ..... H01H 23/16; H01H 23/24; H01H 23/04
USPC ..... 200/553, 556, 557, 339
See application file for complete search history.

(56) References Cited

U.S. PATENT DOCUMENTS

| | | | | |
|---|---|---|---|---|
| 1,736,849 | A * | 11/1929 | Douglas | H01H 23/146 74/523 |
| 5,072,086 | A * | 12/1991 | Fujiyoshi | H01H 23/16 200/332.1 |
| 6,891,117 | B1 * | 5/2005 | Gouhl | H01H 23/205 200/339 |
| 10,395,865 | B2 * | 8/2019 | Scruggs | H01H 23/16 |
| 2018/0190451 | A1 | 7/2018 | Scruggs | |

OTHER PUBLICATIONS

Canadian Office Action dated Dec. 2, 2020 corresponding to Canadian Patent Application No. 3,059,183 (4 pages).

* cited by examiner

*Primary Examiner* — Edwin A. Leon
*Assistant Examiner* — Lheiren Mae A Caroc
(74) *Attorney, Agent, or Firm* — Locke Lord LLP

(57) ABSTRACT

Embodiments disclosed provide a switching and operating assembly of a switch. The switch includes a switching assembly including a switching member adapted to move between at least two positions to control an operation state of the switch; and a driving member coupled to the switching member; an operating assembly separated from and detachably arranged on the switching assembly and operable to cause the driving member to rotate; and an elastic component arranged between the switching member and the driving member to hold the switching member in one of the at least two positions. By providing the switch including a switching assembly and an operating assembly separated from each other, any one of the switching assembly and the operating assembly can be replaced separately without changing the overall height of the switch. This significantly increases the flexibility to personalize the switch.

16 Claims, 12 Drawing Sheets

SWITCHING AND OPERATING ASSEMBLY OF A SWITCH

FIELD

Embodiments of the present disclosure generally relate to a switch, and more specifically, to a switch with a switching assembly and an operating assembly separated from and detachably arranged on the switching assembly.

BACKGROUND

Switches are widely used in industrial and home appliances. There are thousands of different shapes of products. As the switch market continues to evolve, more and more users are choosing personalized switches to align, for example, with the style of decoration. However, in some countries/regions, such as the United States, the very strict regulations on switch installation, button size and height increase the difficulty of personalization or customization.

In order to meet various requirements, the current switch in the market is usually a one-piece component. That is, the switch as a one-piece component cannot be disassembled into multiple components. In this event, if a user wants to change the appearance or different colors of the switch, the entire switch needs to be disassembled and replaced. This has severely hindered the personalization and customization of switch products.

SUMMARY

In general, embodiments of the present disclosure provide a switch with a switching assembly and an operating assembly separated from and detachably arranged on the switching assembly.

In a first aspect, embodiments of the present disclosure provide a switch. The switch comprises a switching assembly comprising a switching member adapted to move between at least two positions to control an operation state of the switch; and a driving member coupled to the switching member and operable to rotate to drive a movement of the switching member; and an operating assembly separated from and detachably arranged on the switching assembly and operable to cause the driving member to rotate.

In some embodiments, the operating assembly is operable to rotate between two positions about a first axis to cause the driving member to rotate about a second axis parallel to or coaxial with the first axis.

In some embodiments, the transmission apparatus further comprises a transmission portion coupled to the actuating portion and the performing portion to cause the performing portion to rotate with the actuating portion and a gearbox coupled to the actuating portion and the transmission portion to change a transmission ratio.

In some embodiments, the operating assembly is operable to slide away from or towards the switching assembly to cause the driving member to rotate.

In some embodiments, the operating assembly comprises a motor or an electromagnetic drive member configured to drive the driving member to rotate.

In some embodiments, the switch further comprises a controller communicatively coupled to the motor or the electromagnetic drive unit to control the motor or the electromagnetic drive unit.

In some embodiments, the operating assembly comprises at least one protrusion protruding to the switching member; and the driving member comprises at least one coupling portion coupled to the respective protrusion to cause the driving member to rotate in response to a rotation of the operating assembly.

In some embodiments, the switch further comprises a frame adapted to at least partially receive the operating assembly, so that the operating assembly is detachably arranged on the switching assembly via the frame.

In some embodiments, the frame is fixed to the switching assembly by a locking mechanism.

In some embodiments, the locking mechanism comprises an elastic locking member and a recess adapted to receive the elastic locking member.

In some embodiments, the driving member comprises a slot adapted to receive an end of the switching member.

In some embodiments, the switching assembly further comprises an elastic component arranged between the switching member and the driving member, the elastic component adapted to hold the switching member in one of the at least two positions.

In second aspect, a switching assembly for a switch is provided. The switching assembly comprising a switching member adapted to move between at least two positions to control an operation state of the switch; and a driving member coupled to the switching member and operable to be driven by an operating assembly of the switch separated from and detachably arranged on the switching assembly to drive a movement of the switching member.

In some embodiments, the driving member comprises a slot adapted to receive an end of the switching member.

In some embodiments, the switching assembly further comprises an elastic component arranged between the switching member and the driving member, the elastic component adapted to hold the switching member in one of the at least two positions.

In third aspect, an operating assembly for a switch is provided. The operating apparatus for a switch comprising an operating assembly separated from and detachably arranged on a switching assembly of the switch and operable to actuate the switching assembly to control an operation state of the switch.

In some embodiments, the operating assembly is operable to rotate between two positions about a first axis to cause a driving member of the switching assembly to rotate about a second axis parallel to or coaxial with the first axis.

In some embodiments, the operating assembly is operable to slide away from or towards the switching assembly to control the operation state of the switch.

In some embodiments, the operating assembly comprises a motor or an electromagnetic drive member configured to drive the driving member to rotate.

In some embodiments, the operating assembly further comprises a controller communicatively coupled to the motor or the electromagnetic drive unit to control the motor or the electromagnetic drive unit.

It is to be understood that the Summary is not intended to identify key or essential features of embodiments of the present disclosure, nor is it intended to be used to limit the scope of the present disclosure. Other features of the present disclosure will become easily comprehensible through the description below.

BRIEF DESCRIPTION OF THE DRAWINGS

The above and other objectives, features and advantages of the present disclosure will become more apparent through more detailed depiction of example embodiments of the present disclosure in conjunction with the accompanying drawings, wherein in the example embodiments of the present disclosure, same reference numerals usually represent same components.

Throughout the drawings, the same or similar reference symbols are used to indicate the same or similar elements.

DETAILED DESCRIPTION

Figure 1:
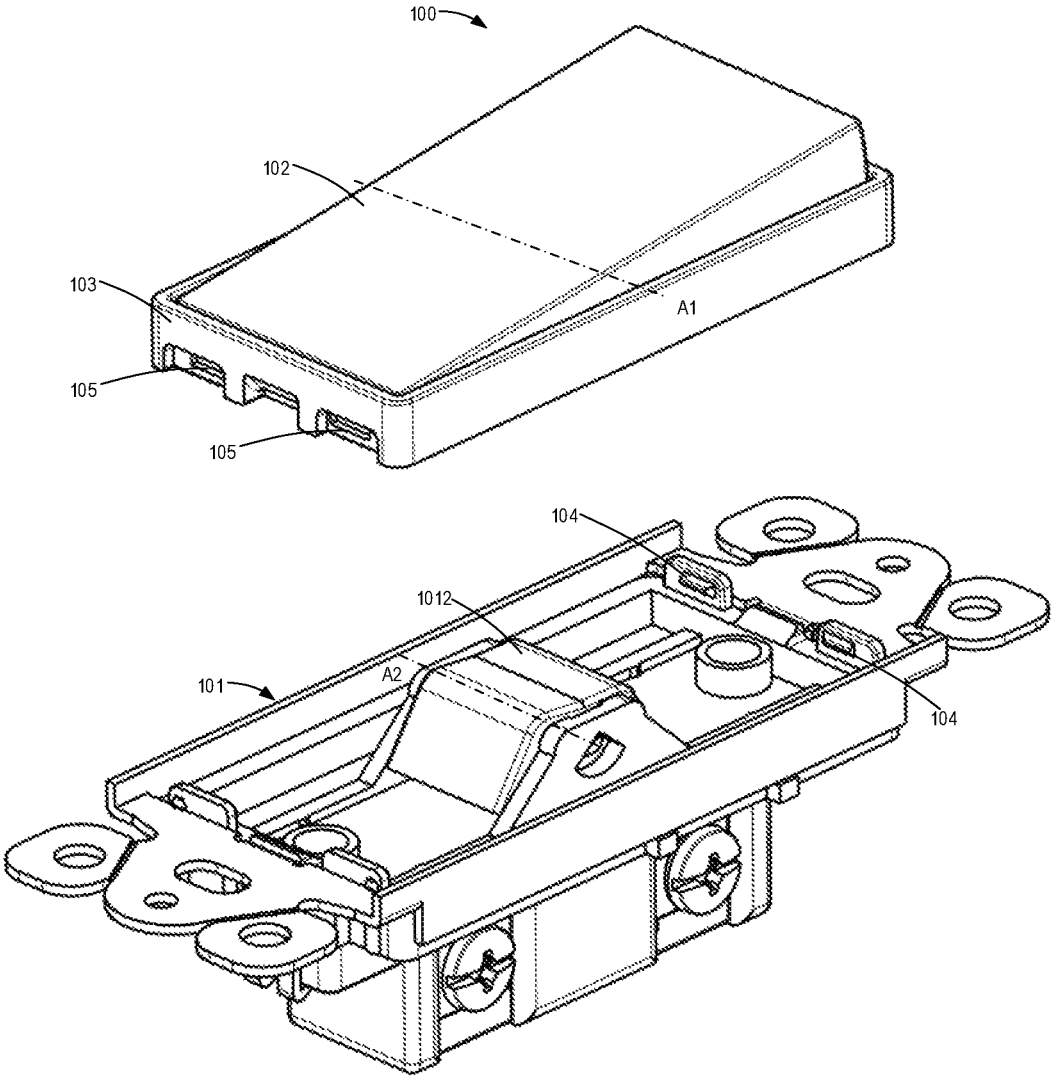
FIG. 1 shows exploded view of a switch according to embodiments of the present disclosure.
Figure 2:
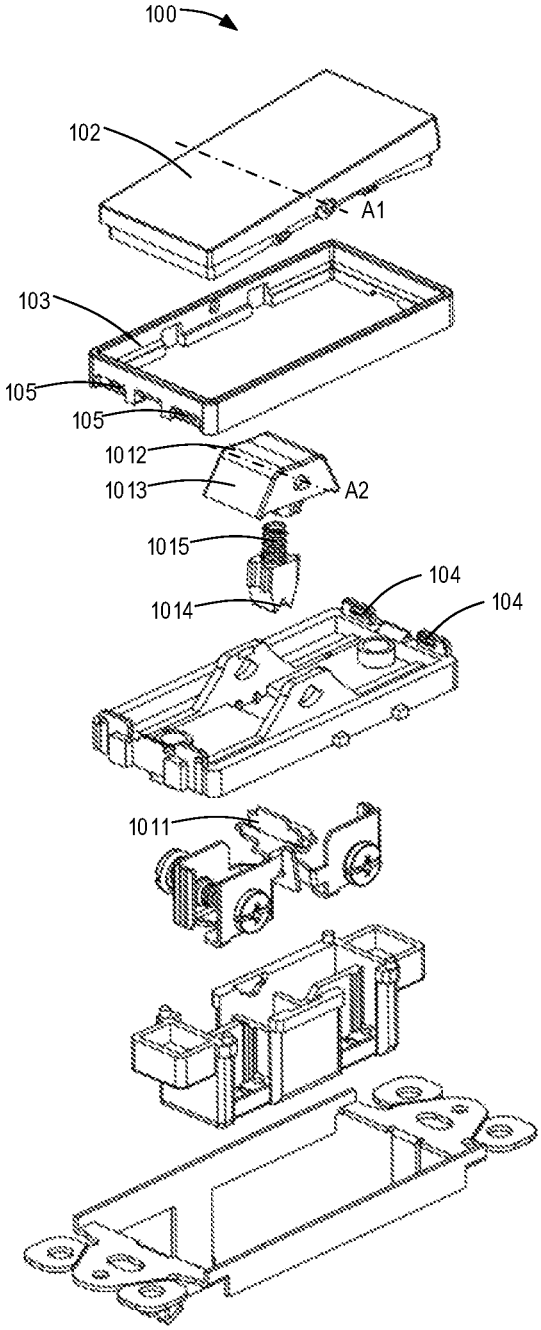
FIG. 2 shows exploded view of a switch according to embodiments of the present disclosure.

Embodiments of the present disclosure will now be discussed with reference to several example embodiments. It is to be understood these embodiments are discussed only for the purpose of enabling those skilled persons in the art to better understand and thus implement the present disclosure, rather than suggesting any limitations on the scope of the subject matter.

As used herein, the term "comprises" and its variants are to be read as open terms that mean "comprises, but is not limited to." The term "based on" is to be read as "based at least in part on." The term "one embodiment" and "an embodiment" are to be read as "at least one embodiment." The term "another embodiment" is to be read as "at least one other embodiment." The terms "first," "second," and the like may refer to different or same objects. Other definitions, explicit and implicit, may be comprised below. A definition of a term is consistent throughout the description unless the context clearly indicates otherwise.

In the conventional solutions, a switch is typically a one-piece component that cannot be disassembled into multiple separate pieces by a general user. The problem with this is that the user can only replace the entire switch if he just wants to change the appearance of the switch. This is bound to waste and significantly reduce the freedom to personalize the switch.

Although some people have recently changed the appearance of the switch by additionally adding a panel to the switch, this method increases the thickness of the switch and the improvement bring about by this is limited. For example, the user may only change the color, size or the like by changing the panel with this approach. However, the press manner such as the press mode and angle of the switch cannot be changed. As a result, this does not make sense for the trend of pursuing constantly personalized products.

In order to at least partially address the above and other potential problems, embodiments of the present disclosure provide a switch 100. Now some example embodiments will be described with reference to FIGS. 1-9.

As shown, the switch 100 comprises two assemblies, namely, a switching assembly 101 and an operating assembly 102 that can be separated from each other in a simple manner by a general user. The switching assembly 101 may be typically arranged in a recess forming in a wall (not shown) for mounting the switch 100. The switching assembly 101 is used to connect the circuit and control on and off of a load on the circuit. To this end, the switching assembly 101 comprising a switching member 1011 and a driving member 1012.

The switching member 1011 can move between at least two positions to control an operation state of the switch. In some embodiments, the switching member 1011 may be referred to a silver bridge. The switching member 1011 is arranged in circuit and can be moved between at least two positions. The at least two positions correspond to the positions for turning the circuit on and off, respectively. In this way, the operation state of the switch 100 can be controlled. The driving member 1012 is coupled to the switching member 1011 and can rotate to drive a movement of the switching member 1011, as shown in FIGS. 1,2,3A and 3B.

The operating assembly 102 can drive the driving member 1012 to rotate to control the operation state of the switch 110. Different from any conventional solutions, the switch 100 comprises the operating assembly 102 that can be separated from and detached arranged on the switching assembly 101. That is, unlike an additional panel attached to the switch as mentioned above, the operating assembly 102 is a part of the switch 100. The user can replace any one of the operating assembly 102 and the switching assembly 101 as needed.

In this way, by replacing the operating assembly 102 with a new operating assembly of different color, size, press manner such as the press mode and press angle or the like, the user can personalize the switch in more ways. For example, a rocker type switch can be changed to a push button type switch by replacing the operating assembly 102. In some embodiments, the conventional bordered switch can be changed to a borderless switch. It is to be understood that the above examples are described merely for illustration, without suggesting any limitations as to the scope of the present disclosure. The switch 100 can be personalized in more suitable ways, which will be discussed in detail below.

Furthermore, compared to the conventional personalized switches, the switch 100 can be personalized without changing the overall thickness of the switch, meeting the assembly requirements. In some embodiments, in order to facilitate the detachable attachment of the operating assembly 102 to the switching assembly 101, the switch may comprise a frame 103 for at least partially receiving the operating assembly 102.

As shown in FIGS. 2, 3A, 3B, 6A and 6B, the switching assembly further comprises an elastic component 1015 arranged between the switching member 1011 and the driving member 1012, The elastic component 1015 is adapted to hold the switching member in one of the at least two positions, as mentioned above. In some embodiments, the frame 103 may be attached to the switching assembly 101 by a locking mechanism. The locking mechanism may comprise a locking member 104 and a recess 105 for receiving the elastic locking member 104, as shown in FIGS. 4A and 4B. In this way, the operating assembly 102 may be detachedly arranged on the switching assembly 101 via the locking mechanism without using screws, making the assembly of the switch 100 easier.

Figure 9:
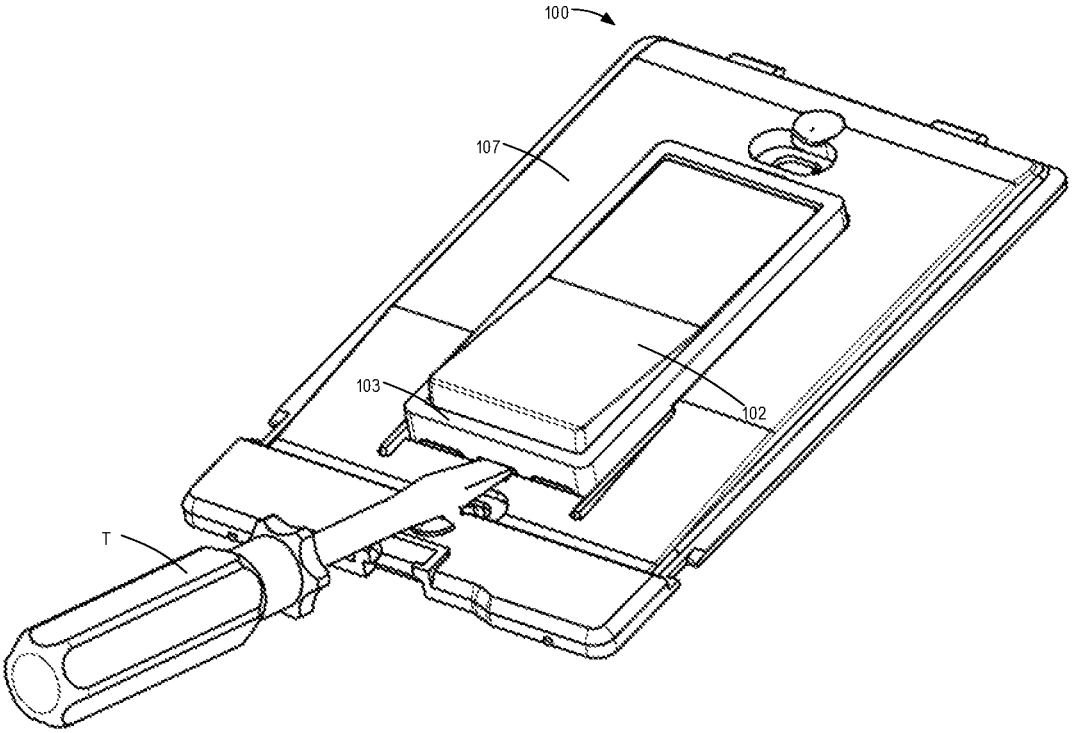
FIG. 9 shows perspective view of an example approach to disassembly of an operating assembly of a switch according to embodiments of the disclosure.

The user can disassemble the operating assembly 102 using a tool T to make the elastic locking member 104 elastic and out of the recess 105, as shown in FIG. 9. It is to be understood that the above embodiments of the locking mechanism are described merely for illustration, without suggesting any limitations as to the scope of the present disclosure. It is possible to use any other suitable structures or arrangements. For example, in some alternative embodiments, the frame 103 may be attached to the switching assembly 101 by snap connection, friction connection or any other suitable means.

In some embodiments, as shown in FIGS. 1, 4A and 4B, the operating assembly 102 may be a form of rocker type panel. That is, the operating assembly 102 may rotate between two positions about a first axis A1. As a result, the driving member 1012 may be driven to rotate about a second axis A2 which is parallel to or coaxial with the first axis A1 to control the operation state of the switch 100.

Figure 3A:
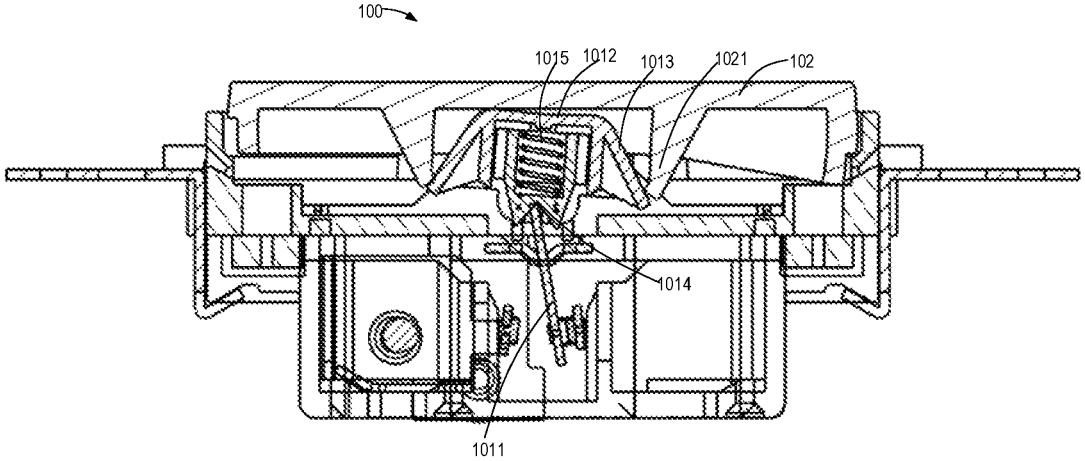
FIGS. 3A and 3B show sectional views of a switch when an operating assembly is in two positions according to embodiments one embodiment of the disclosure.
Figure 3B:
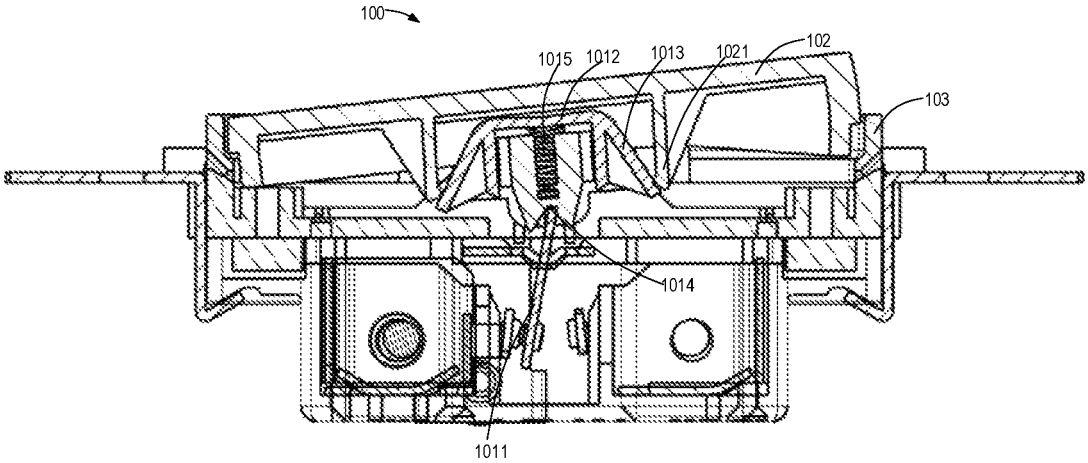
Figure 4A:
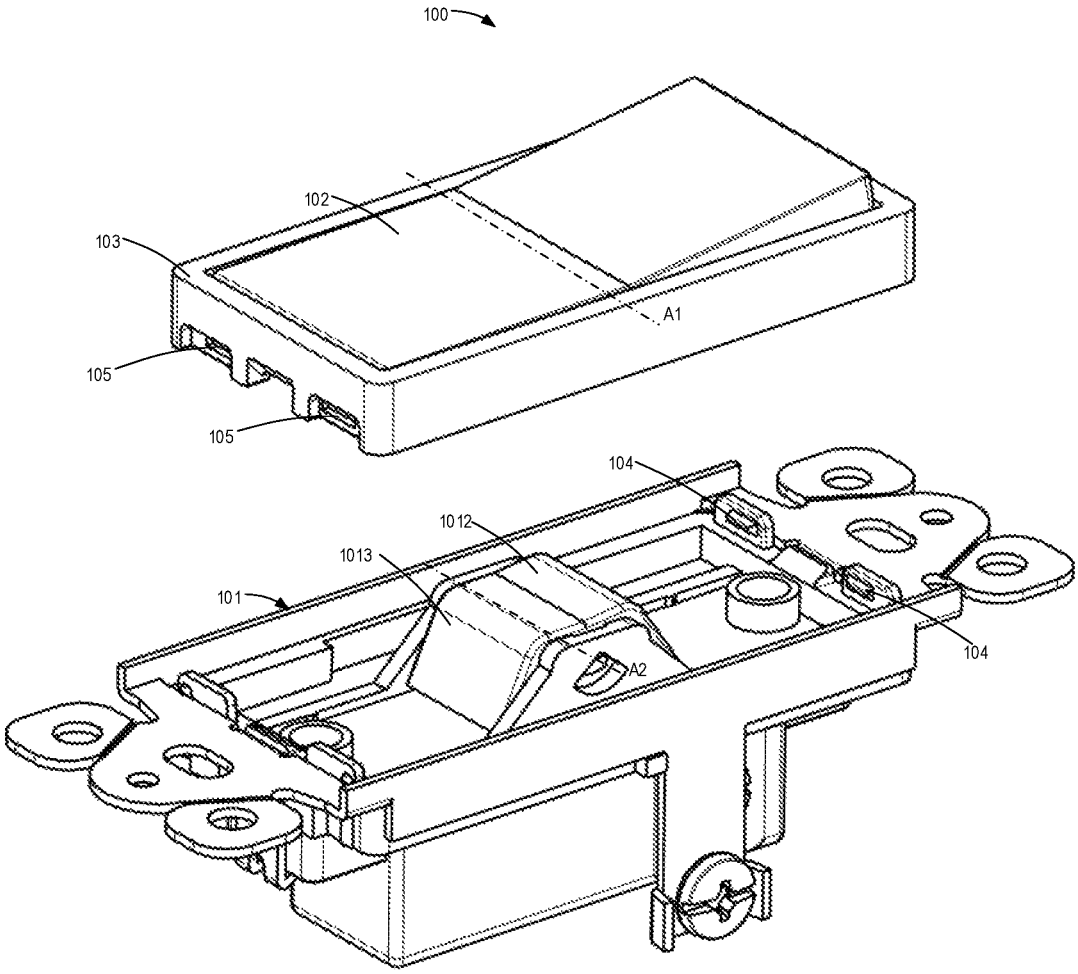
FIGS. 4A and 4B show exploded views of a switch with other forms of an operating assembly when the operating assembly is in two positions according to embodiments one embodiment of the disclosure.
Figure 4B:
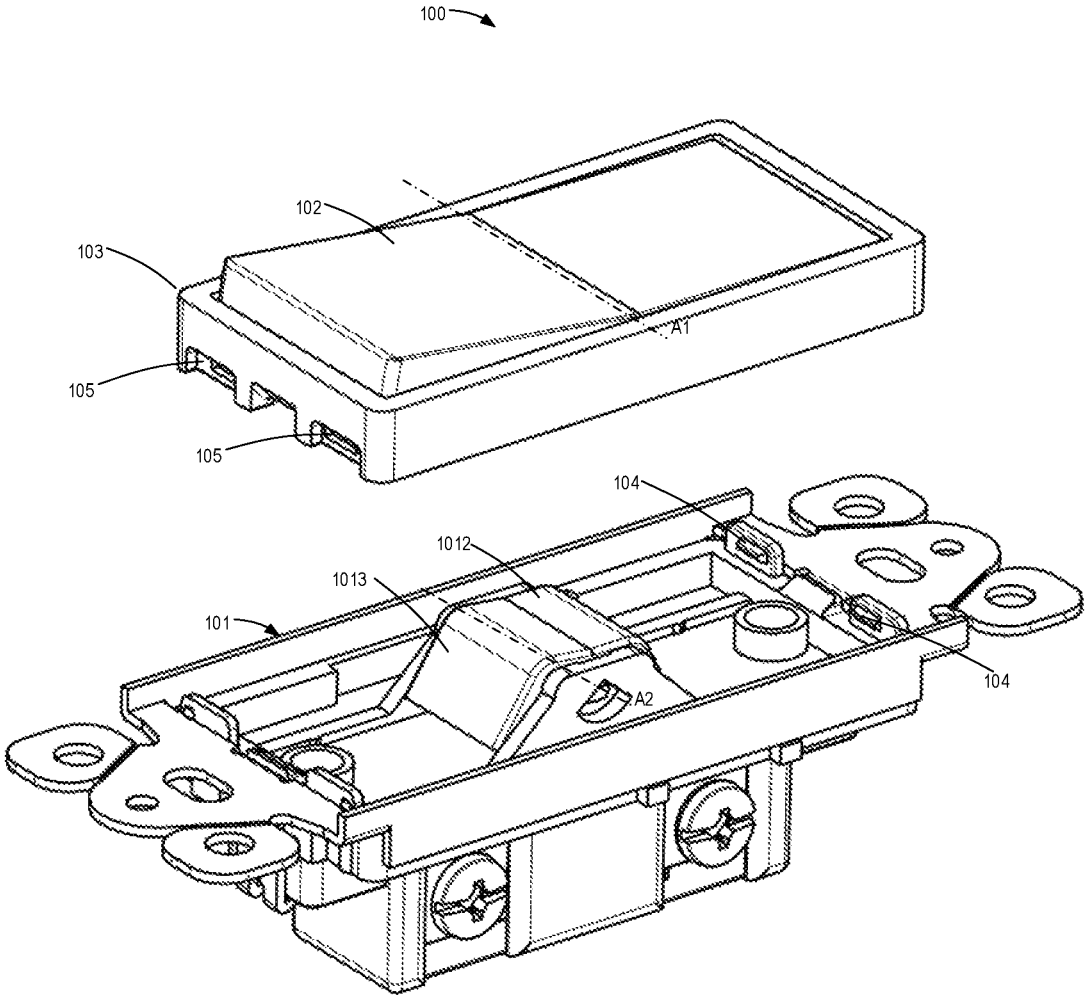

In some embodiments, the operating assembly 102 may comprise at least one protrusion 1021 protruding to the switching member 1011, as shown in FIGS. 3A and 3B. The driving member 1012 may also comprise at least one coupling portion 1013 to be coupled to the respective protrusions 1021. In this way, in response to a rotation of the operating assembly 102, the driving member 1012 may be driven to rotate.

As shown in FIGS. 3A and 3B, the coupling portions 1013 of the driving member 1012 may be tapered. That is, the distance between the coupling portions 1013 increases as the distance from the operating assembly 102 increases. This may promote the coupling between the protrusions 1021 and the coupling portions 1013.

It is to be understood that the above embodiments of the operating assembly 102 are described merely for illustration, without suggesting any limitations as to the scope of the present disclosure. It is possible to use any other suitable structures or arrangements. For example, in some alternative embodiments, the coupling portions 1013 may have a recess or a platform for receiving the protrusions 1021.

Figure 5A:
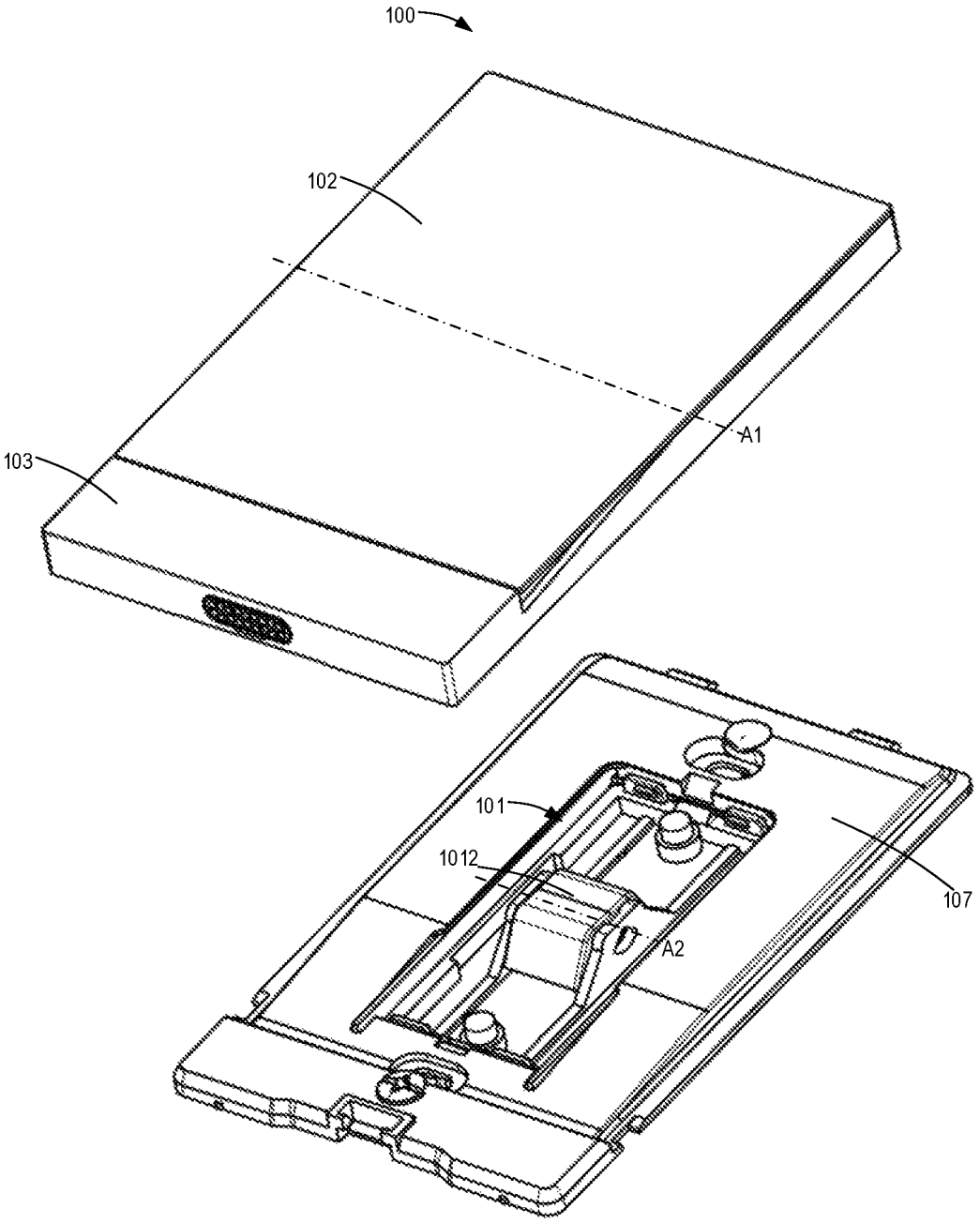
FIGS. 5A and 5B show exploded views of a switch with other forms of an operating assembly when the operating assembly is in two positions according to embodiments one embodiment of the disclosure.
Figure 5B:
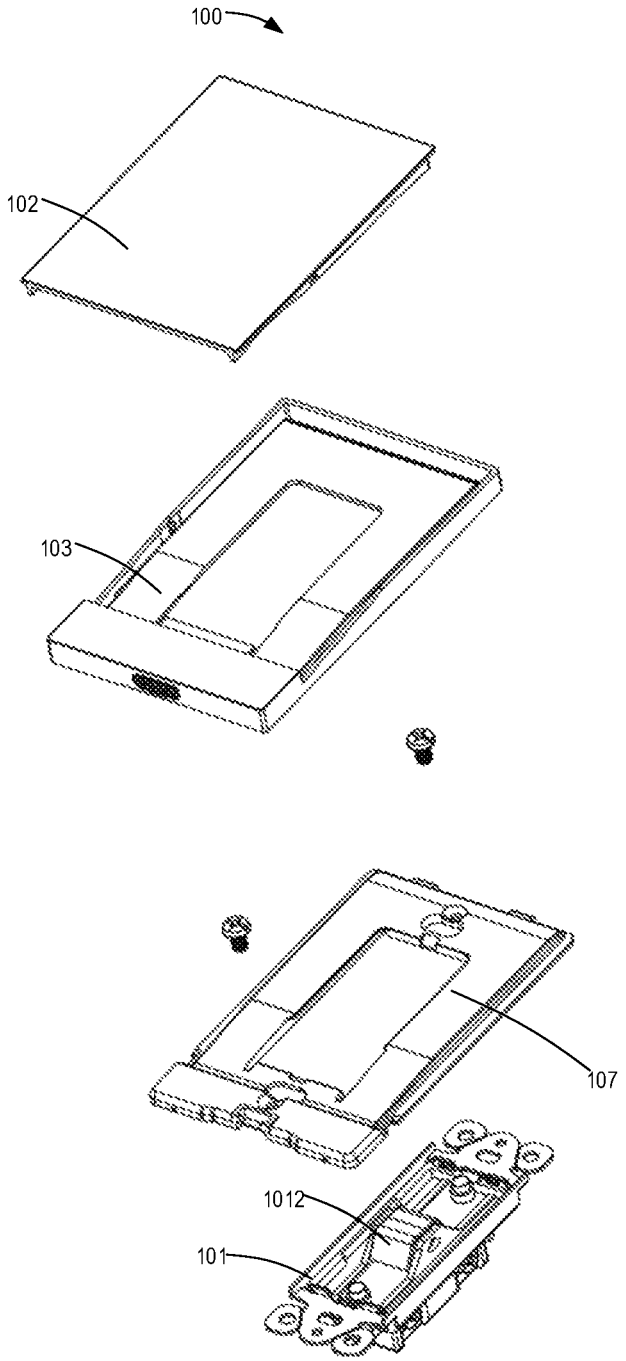
Figure 6A:
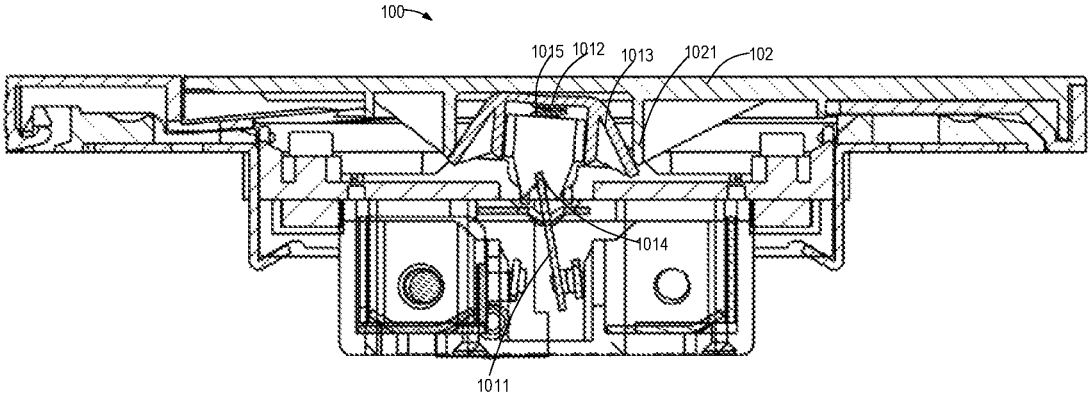
FIGS. 6A and 6B show sectional views of a switch when an operating assembly is in two positions according to embodiments one embodiment of the disclosure.
Figure 6B:
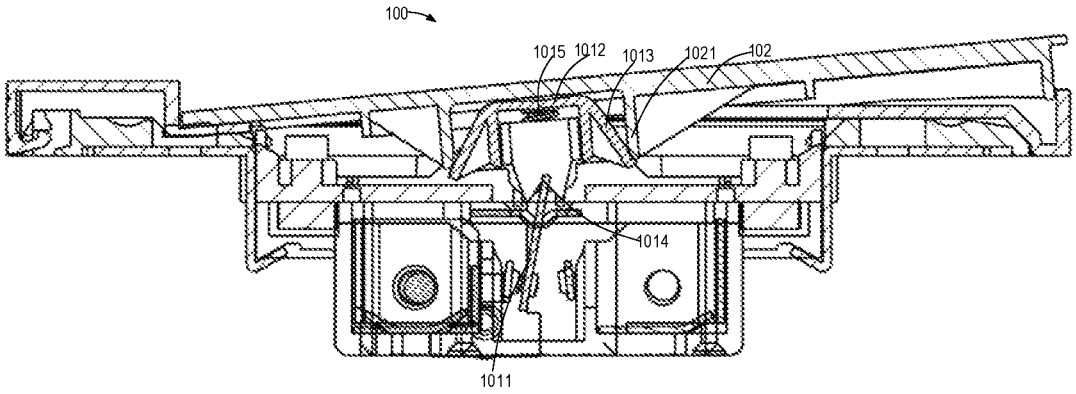

A user can change the type of a rocker switch by changing the style of the operating assembly 102. For example, the user can change the type of the rocker switch by replacing the operating assembly 102 having a plane rocker as shown in FIG. 1 with an operating assembly 102 having a bent surface rocker as shown in FIGS. 3A and 3B. In some embodiments, the switch 100 may also be changed to a large panel or a borderless panel as shown in FIGS. 5A and 5B by simply changing the operating mechanism 102.

Furthermore, the press mode of the operating assembly 102 may also be changed by replacing the different operating assembly 102. For example, an operating assembly 102 having a symmetrical press mode as shown in FIGS. 4A and 4B can be replaced with an operating assembly 102 pressed toward one side as shown in FIGS. 5A and 5B to meet different user needs.

In addition, as mentioned above, the driving member 1012 may rotate about the second axis A2 which is parallel to or coaxial with the first axis A1. In the case where the second axis A2 is parallel to the first axis A1, the rotation angel of the operating assembly 1012, namely, the press stroke of the operating assembly 1012 may also be adjusted by adjusting a distance between the first and second axes A1, A2. Specifically, the farther the two axes A1, A2 are apart, the smaller the press stroke of the operating assembly 1012.

In this way, a user can change the press stroke by replacing the different operating assembly 1012 to achieve a different pressing experience. In some alternative embodiments, no replacement is needed. That is, the distance between the first and second axes A1, A2 may be adjusted, for example, by adjusting a position of the first axis A1 on the frame 103. Accordingly, in this case, the user may adjust the press stroke of the operating assembly 1012 without replacing the operating assembly 1012. This further reduces the cost of the personalization.

The first and second axes A1, A2 may also be coaxial with each other. It is to be understood that the above embodiments of changing between different types of rocker switches 100 are described merely for illustration, without suggesting any limitations as to the scope of the present disclosure. It is possible to change between more different types of switches 100. For example, in some alternative embodiments, the switch 100 may be changed to click-type rocker switch by replacing the respective operating assembly 102.

In some embodiments, the switch 100 may also be changed to push button type switch by changing an operating assembly 102 which may slide away from and towards the switching assembly 101. In this way, by pressing the operating assembly 102 towards the switching assembly 101, the operating assembly 102 may drive the driving member 1012 to rotate to one side, and by pressing the operating assembly 102 again, the driving member 1012 may be driven to rotate to another side. As a result, the operation state of the switch 100 may be controlled by moving the operating assembly 102, just like pressing a button. This further increases the flexibility of the individualization of the switch 100.

In some embodiments, the operating assembly 102 may comprise a motor or an electromagnetic drive member (not shown) to drive the driving member 1012 to rotate. The motor or the electromagnetic drive member can be controlled by a controller. In this way, automatic control of the switch 100 may be achieved. For example, in some embodiments, the controller may control the motor or the electromagnetic drive member wirelessly. As a result, the user may control the operation state of the switch 100 wirelessly.

The controller, the motor or the electromagnetic may be powered by being connected to the circuit in which the switch 100 is connected. In some alternative embodiments, the controller, the motor or the electromagnetic may also be powered by an rechargeable battery. Furthermore, the operating assembly 102 may also comprise a panel for controlling the operation state of the switch 100 locally.

Figure 7A:
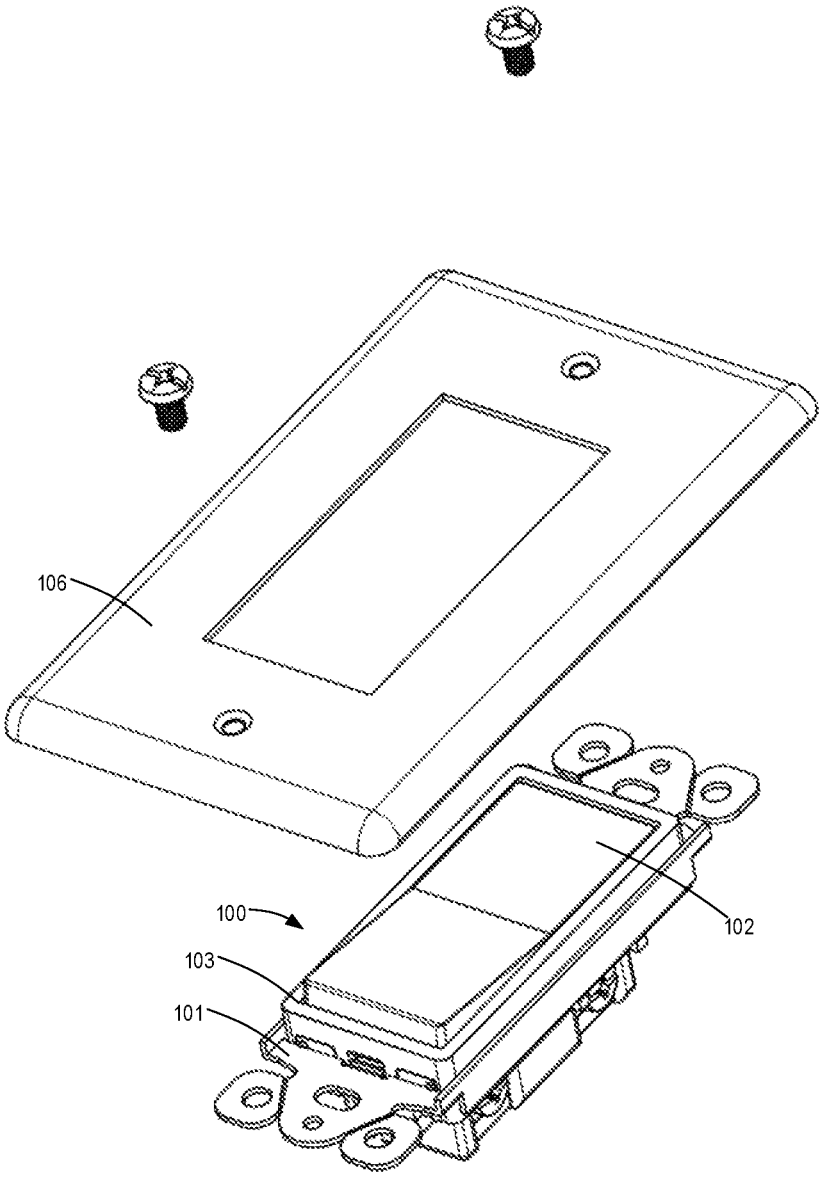
FIGS. 7A and 7B show perspective views of a switch attaching to an additional panel according to embodiments of the disclosure.
Figure 7B:
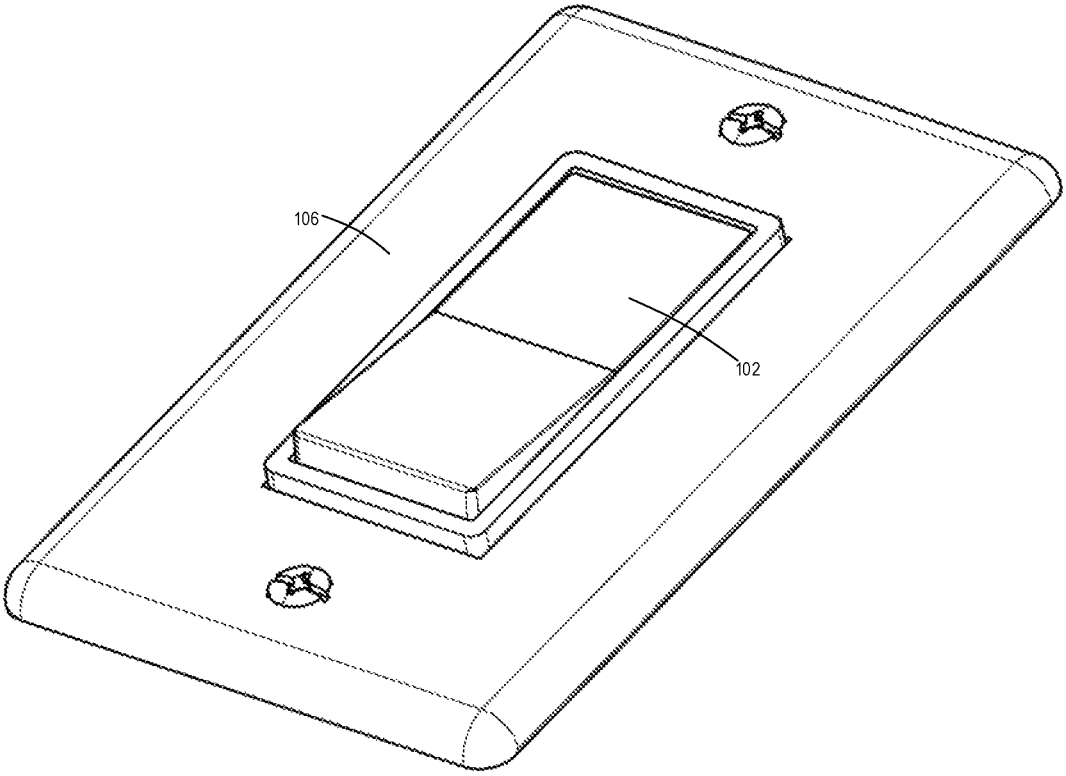
Figure 8:
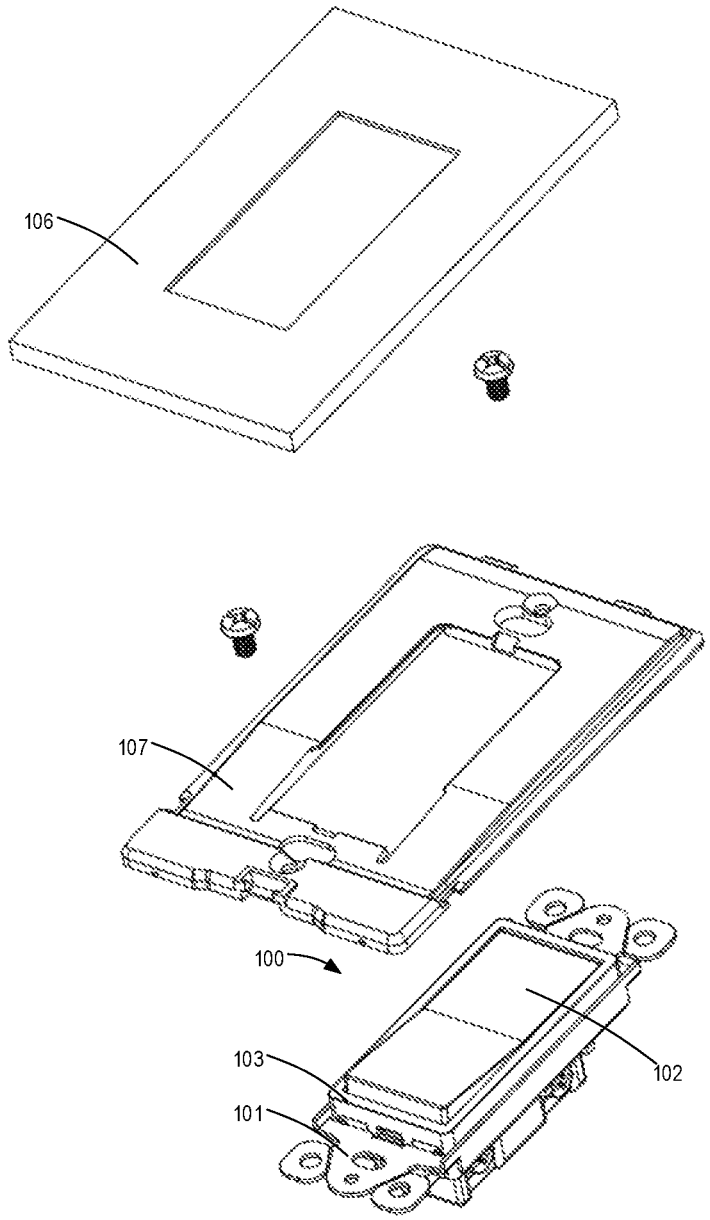
FIG. 8 shows exploded view of a switch attaching to an additional panel according to embodiments of the disclosure.

In addition to the personalized manners described above, the material or the color may also be changed by replacing the operating assembly 102 to achieve the personalization. Furthermore, the switch 100 may also be used like a conventional switch, as shown in FIGS. 7A, 7B and 8. This allows the user to replace the conventional switch with the switch 100 according to embodiments of the present disclosure without changing the recess on the wall for receiving the switch.

For example, as shown in FIGS. 7A and 7B, the switch 100 may also be mounted in the recess on the wall. A panel 106 may then be attached to the wall by using screws to cover the mounting portion of the switch 100. In some alternative embodiments, as shown in FIG. 8, an intermediate panel 107 may be used. Specifically, after the switch 100 is mounted in the recess on the wall, the intermediate panel 107 may be used to cover the mounting portion of the switch 100. The panel 106 may then attached to the intermediate panel 107 by using snap connection, friction connection or the like, as shown in FIG. 8.

In this case, if a user wants to change the appearance of the switch 100 as shown in FIGS. 7A, 7B and 8 to the switch 100 as shown in FIGS. 5A and 5B, he only needs to remove the panel 106 and/or the intermediate panel 107 and the operating assembly 102 and install a new operating assembly as shown in FIGS. 5A and 5B. It can be seen that the flexibility of the switch 100 being personalized is significantly improved.

A second aspect according to embodiments of the present disclosure discloses a switching assembly 101 for a switch 100 as mentioned above. The switching assembly 101 may comprise a switching member 1011 and a driving member 1012. The switching member 1011 can move between at least two positions to control a operation state of the switch 100. The driving member 1012 is coupled to the switching member 1011 and can be driven by an operating assembly 102 as mentioned above to drive a movement of the switching member 1011.

A third aspect according to embodiments of the present disclosure discloses an operating apparatus for a switch 100 as mentioned above. The operating apparatus comprises an operating assembly 102 separated from and detachably arranged on a switching assembly 101 as mentioned above. In this way, the operating assembly 102 may actuate the switching assembly 101 to control the operation state of the switch 100.

It should be appreciated that the above detailed embodiments of the present disclosure are only to exemplify or explain principles of the present disclosure and not to limit the present disclosure. Therefore, any modifications, equivalent alternatives and improvement, etc. without departing from the spirit and scope of the present disclosure shall be comprised in the scope of protection of the present disclosure. Meanwhile, appended claims of the present disclosure aim to cover all the variations and modifications falling under the scope and boundary of the claims or equivalents of the scope and boundary.

What is claimed is:

1. A switch, comprising:

a switching assembly comprising:

a switching member adapted to move between at least two positions to control an operation state of the switch; and a driving member coupled to the switching member and operable to rotate to drive a movement of the switching member; and an operating assembly separated from and detachably arranged on the switching assembly and operable to cause the driving member to rotate, wherein the operating assembly is operable to rotate between two positions about a first axis to cause the driving member to rotate about a second axis parallel to the first axis in a same direction as the operating assembly rotates, wherein the switching assembly further comprises an elastic component arranged between the switching member and the driving member, the elastic component adapted to hold the switching member in one of the at least two positions.

2. The switch of claim 1, wherein the operating assembly is operable to slide away from or towards the switching assembly to cause the driving member to rotate.

3. The switch of claim 1, wherein the operating assembly comprises a motor or an electromagnetic drive member configured to drive the driving member to rotate.

4. The switch of claim 3, further comprising:

a controller communicatively coupled to the motor or the electromagnetic drive unit to control the motor or the electromagnetic drive unit.

5. The switch of claim 1, wherein the operating assembly comprises at least one protrusion protruding to the switching member; and the driving member comprises at least one coupling portion coupled to the respective protrusion to cause the driving member to rotate in response to a rotation of the operating assembly.

6. The switch of claim 1, further comprising:

a frame adapted to at least partially receive the operating assembly, so that the operating assembly is detachably arranged on the switching assembly via the frame.

7. The switch of claim 6, wherein the frame is fixed to the switching assembly by a locking mechanism.

8. The switch of claim 7, wherein the locking mechanism comprises an elastic locking member and a recess adapted to receive the elastic locking member.

9. The switch of claim 1, wherein the driving member comprises a slot adapted to receive an end of the switching member.

10. A switching assembly for a switch, comprising:

a switching member adapted to move between at least two positions to control an operation state of the switch; and a driving member coupled to the switching member and operable to be driven by an operating assembly of the switch separated from and detachably arranged on the switching assembly to drive a movement of the switching member, wherein the operating assembly is operable to rotate between two positions about a first axis to cause the driving member to rotate about a second axis parallel to the first axis in a same direction as the operating assembly rotates, wherein the switching assembly further comprises an elastic component arranged between the switching member and the driving member, the elastic component adapted to hold the switching member in one of the at least two positions.

11. The switching assembly of claim 10, wherein the driving member comprises a slot adapted to receive an end of the switching member.

12. The switching assembly of claim 10, further comprising an elastic component arranged between the switching member and the driving member, the elastic component adapted to hold the switching member in one of the at least two positions.

13. An operating apparatus for a switch, comprising:

an operating assembly separated from and detachably arranged on a switching assembly of the switch and operable to actuate the switching assembly to control an operation state of the switch, wherein the operating assembly is operable to rotate between two positions about a first axis to cause a driving member of the switching assembly to rotate about a second axis parallel to the first axis in a same direction as the operating assembly rotates, wherein the switching assembly further comprises an elastic component arranged between the switching member and the driving member, the elastic component adapted to hold the switching member in one of the at least two positions.

14. The operating apparatus of claim 13, wherein the operating assembly is operable to slide away from or towards the switching assembly to control the operation state of the switch.

15. The operating apparatus of claim 13, wherein the operating assembly comprises a motor or an electromagnetic drive member configured to drive the driving member to rotate.

16. The operating apparatus of claim 15, further comprising a controller communicatively coupled to the motor or the electromagnetic drive unit to control the motor or the electromagnetic drive unit.

* * * * *